US009441821B2

(12) United States Patent
Hashimoto et al.

(10) Patent No.: US 9,441,821 B2
(45) Date of Patent: Sep. 13, 2016

(54) ILLUMINATION LIGHT SOURCE AND LIGHTING APPARATUS

(71) Applicant: PANASONIC CORPORATION, Osaka (JP)

(72) Inventors: Nozomu Hashimoto, Osaka (JP); Toshio Mori, Hyogo (JP); Katsushi Seki, Shiga (JP); Youji Tachino, Nara (JP); Yukiya Kanazawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 264 days.

(21) Appl. No.: 14/156,507

(22) Filed: Jan. 16, 2014

(65) Prior Publication Data

US 2014/0204561 A1 Jul. 24, 2014

(30) Foreign Application Priority Data

Jan. 22, 2013 (JP) ..... 2013-009650

(51) Int. Cl.

| | |
|---|---|
| ***F21V 23/00*** | (2015.01) |
| ***F21V 27/02*** | (2006.01) |
| ***F21K 99/00*** | (2016.01) |

(52) U.S. Cl.

CPC ..... *F21V 23/002* (2013.01); *F21K 9/1355* (2013.01); *F21K 9/30* (2013.01); *F21K 9/90* (2013.01); *F21V 23/006* (2013.01); *F21V 27/02* (2013.01)

(58) Field of Classification Search

CPC .... F21V 23/002; F21V 27/02; F21V 23/006; F21K 9/1355; F21K 9/30

See application file for complete search history.

(56) References Cited

U.S. PATENT DOCUMENTS

| | | | | |
|---|---|---|---|---|
| 2012/0057371 | A1 | 3/2012 | Kai et al. | |
| 2013/0077285 | A1 | 3/2013 | Isogai et al. | |
| 2013/0201697 | A1 | 8/2013 | Osada et al. | |
| 2013/0294082 | A1 | 11/2013 | Matsuda et al. | |
| 2015/0123572 | A1* | 5/2015 | Takeda ..... | H05B 33/0803 315/307 |

FOREIGN PATENT DOCUMENTS

| | | |
|---|---|---|
| EP | 2224161 | 9/2010 |
| EP | 2711605 | 3/2014 |
| JP | 09-320313 | 12/1997 |
| JP | 2012-227172 | 11/2012 |

(Continued)

OTHER PUBLICATIONS

Search report from E.P.O., mail date is Apr. 16, 2014.
U.S. Appl. No. 14/156,508 to Toshio Mori et al., filed Jan. 16, 2014.
U.S. Appl. No. 14/157,676 to Yukiya Kanazawa et al., filed Jan. 17, 2014.

(Continued)

*Primary Examiner* — David V Bruce
(74) *Attorney, Agent, or Firm* — Greenblum & Bernstein, P.L.C.

(57) ABSTRACT

An LED unit which serves as an illumination light source includes: a light-emitting element; a circuit board provided in a drive circuit which drives the light-emitting element; a lead wire electrically connecting the light-emitting element and the drive circuit; and a case including a first opening which is an elongated opening into which the lead wire is inserted. The circuit board includes a second opening which is an elongated opening into which the lead wire is inserted, and the first opening and the second opening are disposed so that a straight line extending in a lengthwise direction of the first opening and a straight line extending in a lengthwise direction of the second opening three-dimensionally cross each other.

9 Claims, 14 Drawing Sheets

(56) References Cited

FOREIGN PATENT DOCUMENTS

| | | | | |
|---|---|---|---|---|
| JP | WO 2012160731 A1 * | 11/2012 | ..... | F21K 9/1355 |
| WO | 2012/005239 | 1/2012 | | |
| WO | 2012/042843 | 4/2012 | | |
| WO | 2012/160731 | 11/2012 | | |

OTHER PUBLICATIONS

U.S. Appl. No. 14/156,506 to Youji Tachino et al., filed Jan. 16, 2014.

Foreign Official Action received in Japan Application No. 2013-009650, dated Jun. 28, 2016.

* cited by examiner

ILLUMINATION LIGHT SOURCE AND LIGHTING APPARATUS

CROSS REFERENCE TO RELATED APPLICATION

The present application is based on and claims priority of Japanese Patent Application No. 2013-009650 filed on Jan. 22, 2013. The entire disclosure of the above-identified application, including the specification, drawings and claims is incorporated herein by reference in its entirety.

FIELD

The present invention relates to an illumination light source using a light-emitting element such as a light-emitting diode (LED) as a light source and to a lighting apparatus including the illumination light source.

BACKGROUND

Conventionally, LED lamps which are disc-shaped or low-profile illumination light sources using LEDs as a light source have been proposed (for example, see Patent Literature (PTL) 1). Generally, such LED lamps include a disk-shaped or low-profile case, and disposed inside the case are a drive circuit which causes an LED to emit light, and a lead wire for electrically connecting the LED and the drive circuit.

CITATION LIST

Patent Literature

[PTL 1] International Publication No. 2012-005239

SUMMARY

Technical Problem

However, with the above-described conventional LED lamp, there is the problem that in some cases the lead wire interferes with other components during assembly, thus making assembly work difficult.

Specifically, there is the possibility that, during the assembly of the LED lamp, the lead wire connecting the LED and the drive circuit may come into contact with other components, the lead wire may get pinned down by the component, or the lead wire may get in the way and make the assembly work for the component difficult.

The present invention is conceived to solve the aforementioned problem and has as an object to provide an illumination light source and a lighting apparatus which are capable of preventing the lead wire from interfering with other components during assembly, and thus allow assembly work to be performed easily.

Solution to Problem

In order to achieve the aforementioned object, an illumination light source according to an aspect of the present invention includes: a light-emitting element; a circuit board provided in a drive circuit which drives the light-emitting element; a lead wire electrically connecting the light-emitting element and the drive circuit; and a case including a first opening which is an elongated opening into which the lead wire is inserted, wherein the circuit board includes a second opening which is an elongated opening into which the lead wire is inserted, and the first opening and the second opening are disposed so that a straight line extending in a lengthwise direction of the first opening and a straight line extending in a lengthwise direction of the second opening three-dimensionally cross each other.

Furthermore, the case may further include a third opening which is an opening connected to the first opening, for guiding the lead wire from outside to the first opening.

Furthermore, the third opening may be disposed at a position that does not overlap with the second opening, when seen from a plan view direction of the circuit board.

Furthermore, the first opening and the third opening may make up an L-shaped cut-out formed in the case.

Furthermore, the second opening may be a linear cut-out formed in the circuit board.

Furthermore, the circuit board may further include a fourth opening which is an opening connected to the second opening, for guiding the lead wire from outside to the second opening.

Furthermore, in order to achieve the aforementioned object, a lighting apparatus according to an aspect of the present invention includes: the above-described illumination light source; and lighting equipment to which the illumination light source is attached, wherein the lighting equipment includes: a main body configured to cover the illumination light source; and a socket attached to the main body, for supplying power to the illumination light source.

Advantageous Effects

An illumination light source and a lighting apparatus according to the present invention are capable of preventing the lead wire from interfering with other components during assembly, and thus allow assembly work to be performed easily.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENT

Hereinafter, LED units (LED lamps), which serve as the illumination light sources, and a lighting apparatus according to exemplary embodiments of the present invention shall be described with reference to the drawings. It should be noted that each of subsequently-described exemplary embodiments shows one specific preferred example of the present invention. The numerical values, shapes, materials, structural components, the arrangement and connection of the structural components, etc. shown in the following exemplary embodiments are mere examples, and are not intended to limit the scope of the present invention. Furthermore, among the structural components in the following exemplary embodiments, components not recited in any one of the independent claims are described as arbitrary structural components included in a more preferable form. Moreover, the respective figures do not necessarily show precise dimensions, etc.

Embodiment 1

First, an outline configuration of an LED unit 1 according to Embodiment 1 of the present invention shall be described.

Figure 1A:
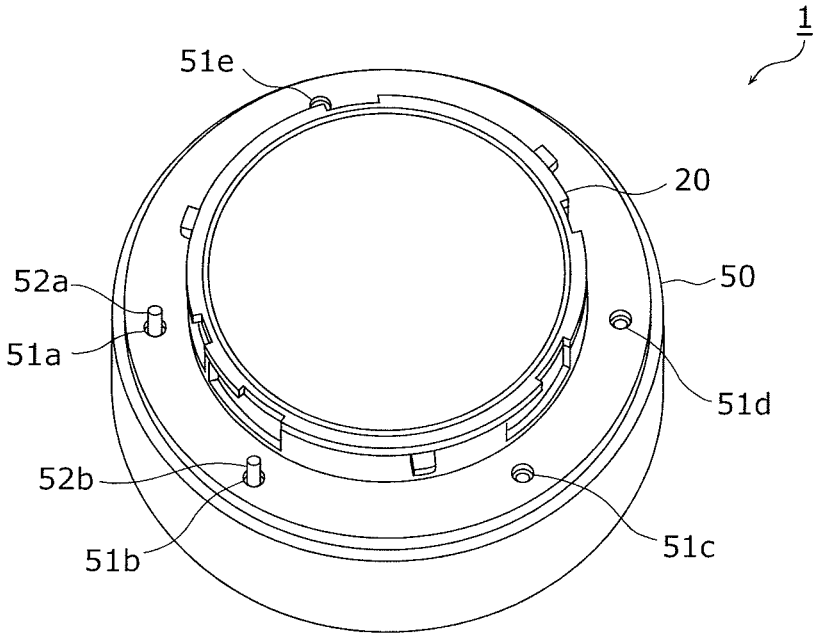
FIG. 1A is a perspective view of an external appearance of an LED unit according to Embodiment 1 of the present invention.
Figure 1B:
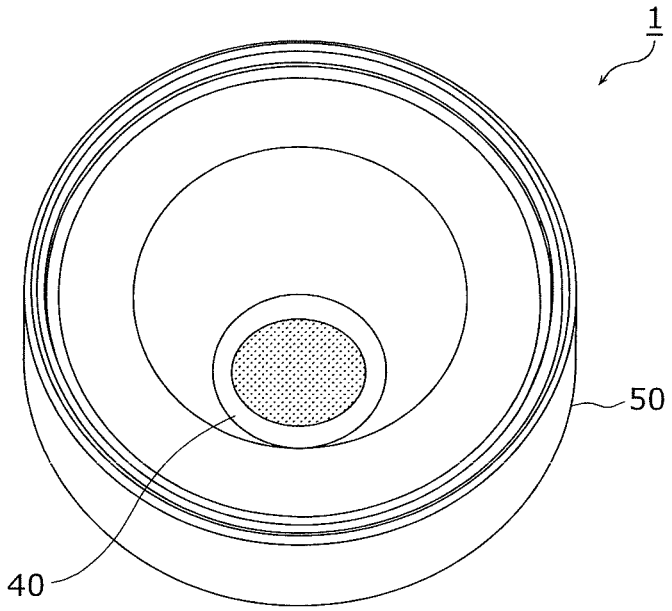
FIG. 1B is a perspective view of an external appearance of the LED unit according to Embodiment 1 of the present invention.

FIG. 1A and FIG. 1B are perspective views of the external appearance of the LED unit 1 according to Embodiment 1 of the present invention. Specifically, FIG. 1A is a perspective view of the LED unit 1 when viewed obliquely from above, and FIG. 1B is a perspective view of the LED unit 1 when viewed obliquely from below. It should be noted that, although an opening of the LED unit 1 is blocked by a cover, the cover is a transparent component and thus the inside of the LED unit 1 can be seen through the cover in FIG. 1B.

Here, in FIG. 1A, the LED unit 1 is illustrated in such a way that the side where light is elicited from the LED unit 1 (hereafter called light-emission side) is the underside, and, in FIG. 1B, the LED unit 1 is illustrated in such a way that the light-emission side is the topside. Hereinafter, description shall be carried out with the light-emission side as the front side (forward), the side opposite the light-emission side as the back side (backward), and a direction crossing the longitudinal (front-back) direction as a sideward direction.

As shown in these figures, the LED unit 1 is an illumination light source having a disk-like or low-profile overall shape. Specifically, the LED unit 1 is an LED lamp having, for example, a GH76p base. More specifically, the LED unit 1 has, for example, an outer diameter of between 50 and 100 mm and a height of between 30 and 50 mm, and when the LED unit 1 is a 20 W LED lamp, the outer diameter is, for example, 90 mm and the height is 45 mm.

Furthermore, the LED unit 1 includes a support 20 that is attached to lighting equipment (not illustrated), a mounting board 40 on which a light-emitting element is provided, and a case 50 that is connected to the support 20.

Furthermore, five through holes 51 (through holes 51*a* to 51*e* in the figure) are formed in a circle in the back side face (face on the lighting equipment side) of the case 50. An electrical connection pin 52 for electrically connecting with the lighting equipment is inserted in each through hole 51. It should be noted that, although electrical connection pins 52*a* and 52*b* are inserted through the through holes 51*a* and 51*b* in the figure, electrical connection pins 52*c* to 52*e* (not illustrated) are also inserted through the through holes 51*c* to 51*e*, respectively.

Here, for example, the electrical connection pins 52*a* and 52*b* are power supply pins, the electrical connection pins 52*c* and 52*d* are light adjustment pins, and the electrical connection pin 52*e* is a grounding pin. It should be noted that, for example, in the case where light adjustment will not be performed, the through holes 51*c* and 51*d* are not formed and the electrical connection pins 52*c* and 52*d* are not inserted. Furthermore, a through hole 51 into which an electrical connection pin 52 is not inserted may be closed, and the through hole 51 need not be formed.

It should be noted that the electrical connections pin 52 of the LED unit 1 are not limited to being provided at the backside of the case 50. For example, the electrical connection pins 52 may be provided at the side of the case 50. In this case, the size of the outer diameter of a heat-dissipating component is not easily restricted by the electrical connection pins 52, and thus the degree of freedom in the design of the heat-dissipating component is improved.

Furthermore, the electrical connection pins 52 are not limited to a rod shape, and may be of another shape such as plate-like, or the like.

Next, the detailed configuration of the LED unit 1 according to Embodiment 1 of the present invention shall be described.

Figure 2:
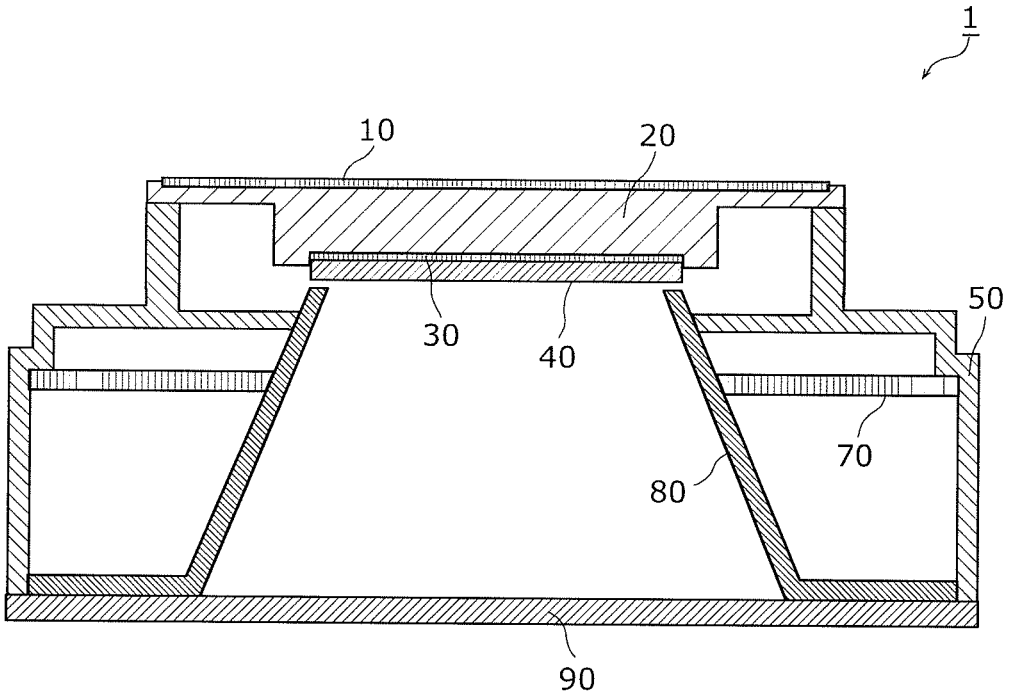
FIG. 2 is a diagram showing a configuration of the LED unit according to Embodiment 1 of the present invention.
Figure 3:
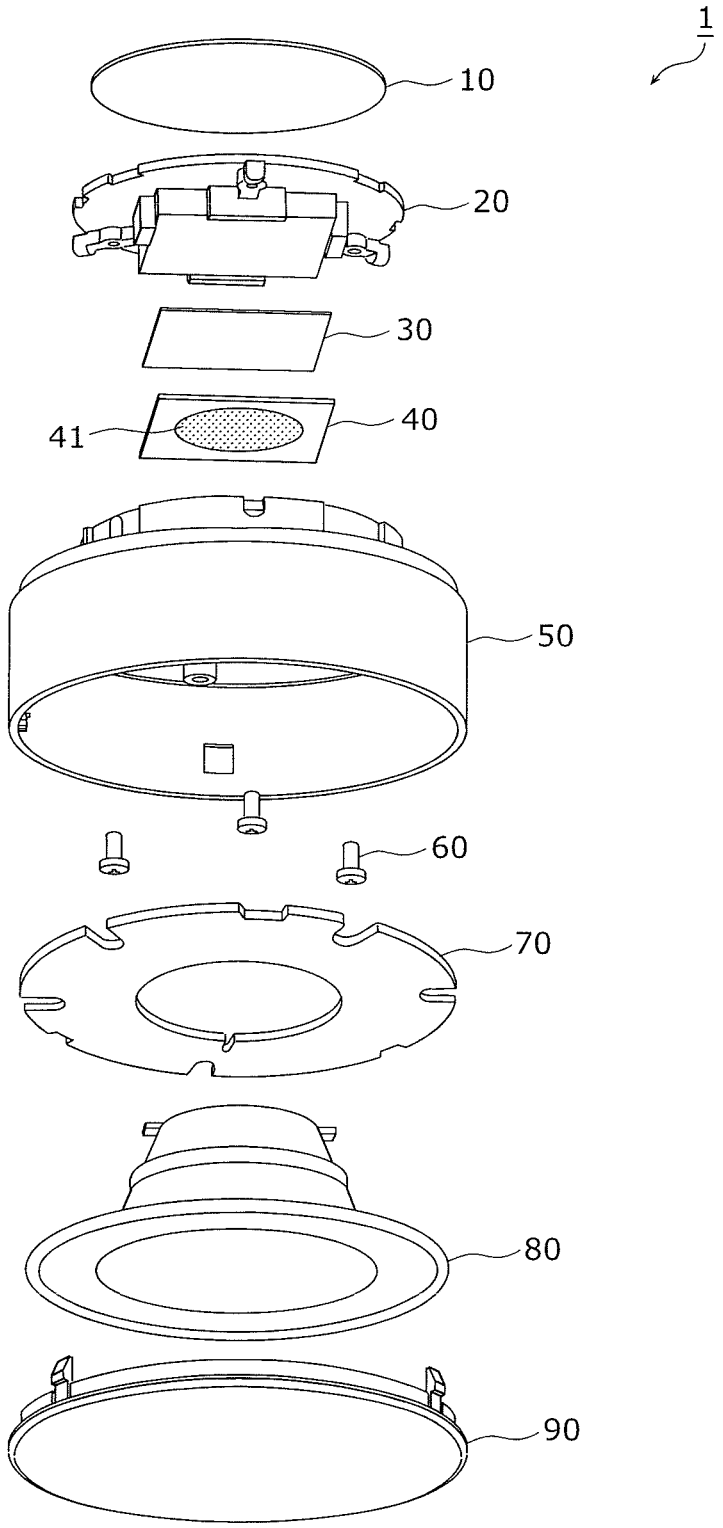
FIG. 3 is a diagram showing the configuration of the LED unit according to Embodiment 1 of the present invention.

FIG. 2 and FIG. 3 are diagrams showing the configuration of the LED unit 1 according to Embodiment 1 of the present invention. Specifically, FIG. 2 is an outline diagram of the cross-section obtained when the LED unit 1 is cut longitudinally, and FIG. 3 is a diagram showing the respective structural components when the LED unit 1 is disassembled.

As shown in these figures, the LED unit 1 includes a heat-conducting sheet 10, the support 20, a heat-conducting sheet 30, the mounting board 40, the case 50, securing screws 60, a circuit board 70, a reflecting mirror 80, and a translucent cover 90.

The heat-conducting sheet 10 is a heat-conductive sheet disposed on the back face of the support 20, for releasing, to the lighting equipment side, the heat from the mounting board 40 that is transmitted via the support 20. Specifically, the heat-conducting sheet 10 is a sheet made of rubber or resin, and is, for example, a silicon sheet or an acrylic sheet.

The support 20 is a component that is connected to the lighting equipment. Specifically, for example, a GH76p base structure is formed in the back portion of the support 20, and is attached and secured to the lighting equipment. Furthermore, the support 20 is a pedestal on which the mounting board 40 is attached, and is disposed on a side opposite the light-emission-side of the mounting board 40. Furthermore, it is preferable that the support 20 be made of highly heat-conductive material such as aluminum. In other words, the support 20 plays the role of a heat sink which dissipates the heat of the mounting board 40.

The heat-conducting sheet 30 is a heat-conductive sheet that thermally connects the mounting board 40 and the support 20. Specifically, the heat-conducting sheet 30 is a heat-conductive sheet that can efficiently transmit the heat from the mounting board 40 to the support 20, and release the heat to the lighting equipment side. It should be noted that, in the case where the mounting board 40 is a metal board, it is preferable that the heat-conducting sheet 30 be an insulating sheet that provides insulation between the mounting board 40 and the support 20. Specifically, the heat-conducting sheet 30 is a sheet made of rubber or resin, and is, for example, a silicon sheet or an acrylic sheet. Moreover, the heat-conducting sheet 30 may be a liquid component, and so on, such as grease.

The mounting board 40 is disposed inside the case 50 and is a board on which a light-emitting element such as a semiconductor light-emitting element is provided. The mounting board 40 is, for example, configured to be plate-like, and has one face on which the light-emitting element is mounted, and another face that can be thermally connected to the support 20. Furthermore, it is preferable that the mounting board 40 be made of highly heat-conductive material, and is, for example, made of an alumina substrate made of alumina. It should be noted that, aside from an alumina substrate, a ceramic substrate made of other ceramic material such as aluminum nitride, metal substrates made of aluminum, copper, or the like, or a metal-core substrate having a stacked structure of a metal plate and a resin substrate may be used for the mounting board 40.

Specifically, a light-emitting unit 41, which has a light-emitting element that emits light toward the front, is provided in the mounting board 40. The light-emitting unit 41 includes one or plural LED chips (not illustrated) mounted on the mounting board 40, and a sealing component (not illustrated). The LED chips are mounted on one of the faces of the mounting board 40 by die bonding, or the like. It should be noted that, for example, blue LED chips which emit blue light having a central wavelength at between 440 and 470 nm are used as the LED chips. Furthermore, the sealing component is a phosphor-containing resin made of a resin containing phosphor, for protecting the LED chips by sealing the LED chips, as well as for converting the wavelength of the light from the LED chips. As a sealing component, for example, in the case where the LED chips are blue light-emitting LEDs, a phosphor-containing resin in which yttrium, aluminum, and garnet (YAG) series yellow phosphor particles are dispersed in silicone resin can be used to obtain white light. With this, white light is emitted from the light-emitting unit 41 (sealing component) due to the yellow light obtained through the wavelength conversion by the phosphor particles and the blue light from the blue LED chips.

Furthermore, the outer diameter of the light-emitting unit 41 is, for example, between 5 and 50 mm, and when the LED unit 1 is a 20 W LED lamp, the outer diameter of the light-emitting unit 41 is, for example, 20 mm.

It should be noted that although a round light-emitting unit 41 is given as an example in this embodiment, the shape or structure of the light-emitting unit in the present invention is not limited to a round one. For example, a square-shaped light-emitting unit may be used. Furthermore, the arrangement of the LED chips is not particularly limited. For example, the LED chips may be sealed in a line, matrix, or circular form.

The case 50 is a longitudinally-short, low-profile (disc-like), cylindrical case surrounding the light-emission side of the LED unit 1. Specifically, each of the front portion and back portion of the case 50 has an opening. The back portion of the case 50 is secured to the support 20 by way of the securing screws 60, and the translucent cover 90 is attached to the front portion of the case 50. In addition, the heat-conducting sheet 30, the mounting board 40, the circuit board 70, and the reflecting mirror 80 are disposed inside the case 50. The case 50 is configured of a resin case made of a synthetic resin having insulating properties, such as polybutylene terephthalate (PBT).

Furthermore, as shown in FIG. 1A, the case 50 includes the electrical connection pins 52 which are power receiving units that receive power for causing the LED chip mounted on the mounting board 40 to emit light. Specifically, the electrical connection pins 52 for supplying power receive alternating-current (AC) power, and the received AC power is input to the circuit board 70 via a lead wire. Detailed description of the configuration of the case 50 shall be provided later.

The securing screws 60 are screws for securing the case 50 to the support 20. It should be noted the case 50 and the support 20 are not limited to being secured using screws. For example, the case 50 and the support 20 may have interfitting regions, and the case 50 may be connected to the support 20 through the interfitting of these regions. Alternatively, the case 50 may be joined to the support 20 by using an adhesive.

The circuit board 70 is disposed inside the case 50, and is a circuit board provided in a drive circuit which drives the light-emitting element. Here, the drive circuit is configured of the circuit board 70 and plural circuit elements (electronic components) mounted on the circuit board 70. In other words, the drive circuit and the light-emitting element are electrically connected by lead wires, and the circuit board 70 causes the light-emitting element to emit light, stop emitting light, or modulate light emission, according to the drive circuit.

Specifically, the circuit board 70 is disposed laterally to the light-emitting unit 41 when the LED unit 1 is viewed from the front (light-emission side), and is a power source circuit board having a circuit element for causing the light-emitting element of the light-emitting unit 41 to emit light. The circuit board 70 is a disk-shaped board in which a circular opening is formed (i.e., donut-shaped board), and is disposed inside the case 50 and outside the reflecting mirror 80. In addition, the circuit element (electronic component) mounted on the circuit board 70 is disposed in the space inside the case 50 and outside the reflecting mirror 80.

In other words, the circuit board 70 is a printed board on which metal lines are formed by patterning, and electrically connects the circuit elements mounted on the circuit board 70 to each other. In this embodiment, the circuit board 70 is disposed such that its principal surface is oriented orthogonally to the lamp axis. The circuit elements are, for example, various types of capacitors, resistor elements, rectifier circuit elements, coil elements, choke coils (choke transistors), noise filters, diodes, or integrated circuit elements, and so on.

Furthermore, since the circuit board 70 is disposed in the back portion of the inside of the case 50, it is preferable that a large-sized circuit element such as, for example, an electrolytic capacitor, choke coil, or the like, be disposed on the front face side of the circuit board 70. It should be noted that although the circuit board 70 is illustrated in this embodiment in a form that is displaced inside the case 50 and outside the reflecting mirror 80, the placement location is not particularly limited and may be arbitrarily designed.

Moreover, with the form in which the circuit board 70 is disposed inside the case 50 and outside the reflecting mirror 80, it is preferable that a large-sized circuit element be disposed on the outer portion of the circuit board 70. This is because, as shown in FIG. 2, when the reflecting mirror 80 has a shape in which the radius widens towards the front, the space formed in the outer portion of the circuit board 70 is larger than the space formed in the inner portion of the circuit board 70.

Specifically, a circuit element (electronic component), or the like, for converting the AC power received from the electrical connection pins 52 for supplying power into direct-current (DC) power is mounted on the circuit board 70. Specifically, the input unit of the circuit board 70 and the electrical connection pins 52 for supplying power are electrically connected by a lead wire or the like, and the output unit of the circuit board 70 and the light-emitting unit 41 of the mounting board 40 are electrically connected by a lead wire or the like. The DC power obtained from the conversion by the circuit board 70 is supplied to the light-emitting unit 41 via a power supply terminal.

The reflecting mirror 80 is an optical component which is disposed on the light-emission side of the mounting board 40, and reflects light emitted from the light-emitting unit 41. In other words, the reflecting mirror 80 reflects, forward, the light emitted from the light-emitting element of the light-emitting unit 41 provided in the mounting board 40. Specifically, the reflecting mirror 80 is disposed in front of the light-emitting unit 41 and inside the case 50 so as to surround the light-emitting unit 41, and includes a cylindrical portion which is formed to have an inner diameter that gradually increases from the light-emitting unit 41 toward the front.

Furthermore, the reflecting mirror 80 is made of a white synthetic resin material having insulating properties. Although it is preferable that the material of the reflecting mirror 80 be a polycarbonate, it is not limited to polycarbonate. It should be noted that, in order to improve reflectivity, the inner face of the reflecting mirror 80 may be coated with a reflective film.

The translucent cover 90 is a low-profile, flat disk-shaped cylindrical component having a bottom, which is attached to the front face of the case 50 in order to protect the components disposed inside the case 50. The translucent cover 90 is secured to the front face of the case 50 by adhesive, rivets, screws, or the like. Furthermore, the translucent cover 90 is made of a highly translucent synthetic resin material such as polycarbonate so as to allow transmission of the outgoing light emitted from the light-emitting unit 41 provided in the mounting board 40.

It should be noted that paint for promoting light-diffusion may be applied to the inner face of the translucent cover 90. Furthermore, phosphor may be included in the translucent cover 90. In this case, the color of the light emitted from the light-emitting unit 41 can be converted by the translucent cover 90.

Furthermore, bumps and indentations (not illustrated) may be formed on the outer face of the translucent cover 90. In this case, when the LED unit 1 is attached to the lighting equipment, the fingers of a worker catch on to the bumps and indentations to allow manipulation of the LED unit 1, and thus facilitate the attachment work.

Next, the configuration of the case 50 and the circuit board 70 shall be described in detail.

Figure 4:
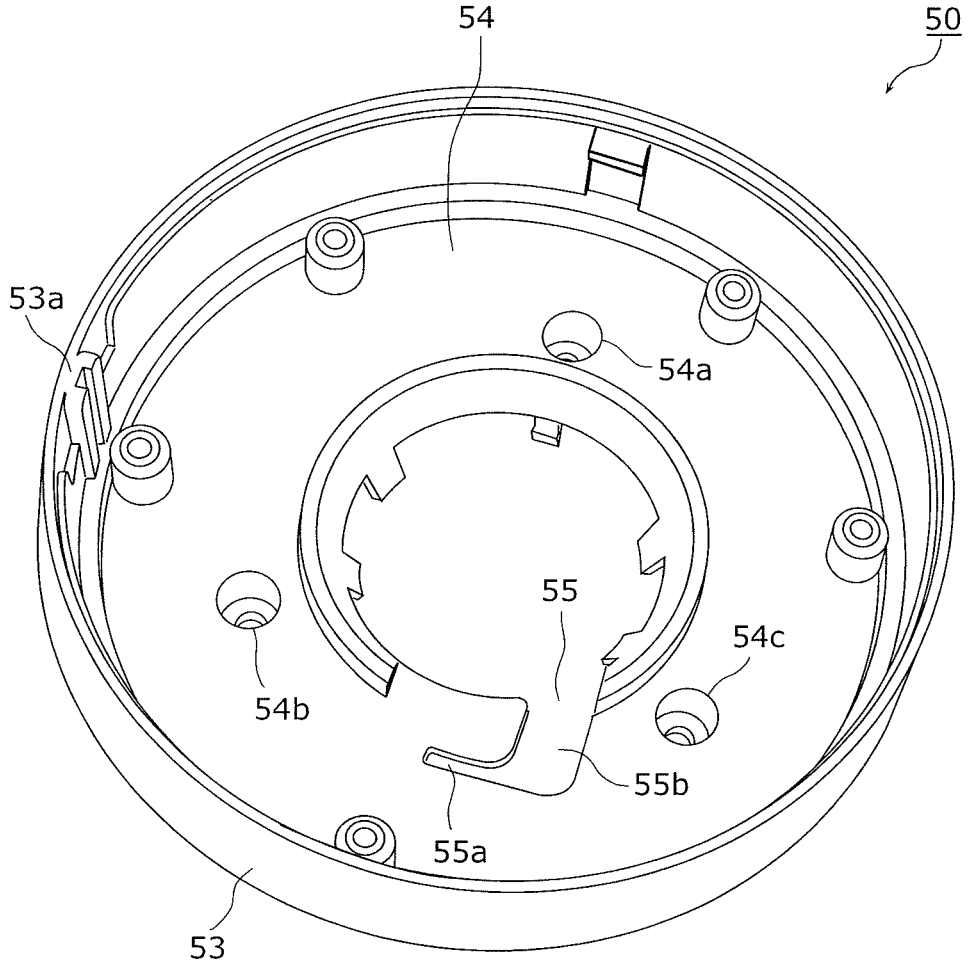
FIG. 4 is a perspective view of a configuration of a case according to Embodiment 1 of the present invention.
Figure 5:
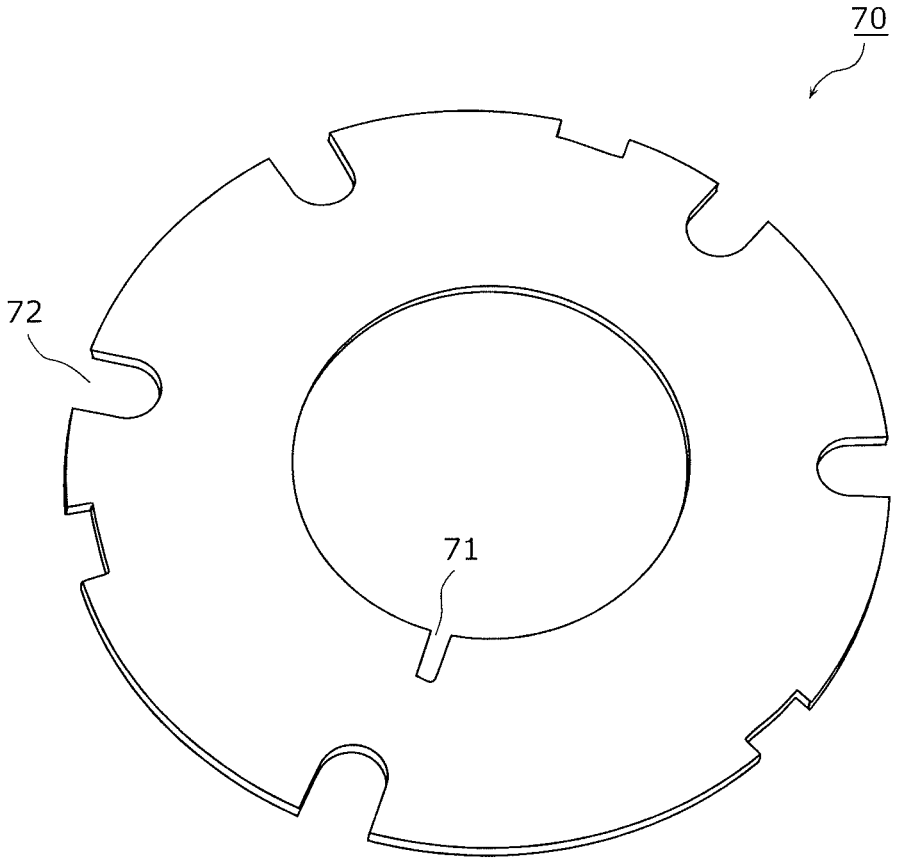
FIG. 5 is a perspective view of a configuration of a circuit board according to Embodiment 1 of the present invention.

FIG. 4 is a perspective view of a configuration of the case 50 according to Embodiment 1 of the present invention. Specifically, the figure is a perspective view of the case 50 as viewed obliquely from the front. Furthermore, FIG. 5 is a perspective view of a configuration of the circuit board 70 according to Embodiment 1 of the present invention. Specifically, the figure is a perspective view of the circuit board 70 as viewed obliquely from the front.

First, as shown in FIG. 4, the case 50 includes an annular case side face 53 and a disk-shaped case top face 54 disposed behind the case side face 53 and having a circular opening formed therein. In other words, the case 50 is formed such that the opening is disposed on the side opposite the support 20.

Furthermore, a projection 53*a* projecting inward is formed in the case side face 53. Here, the projection 53*a* is a region for regulating the rotation of the circuit board 70 and the translucent cover 90. Specifically, the projection 53*a* is a rod-shaped projection which extends longitudinally, and, by abutting the circuit board 70 and the translucent cover 90, is capable of regulating the rotation of the circuit board 70 and the translucent cover 90 with respect to the case 50.

Screw insertion portions 54*a* to 54*c* for the insertion of the securing screws 60 are formed in the case top face 54. Specifically, three securing screws 60 are respectively inserted in the screw insertion portions 54*a* to 54*c*, and the case 50 and the support 20 are fastened by being screwed together.

Furthermore, an opening 55 which is an L-shaped cut-out is formed in the case top face 54. The opening 55 is configured of a first opening 55*a* and a third opening 55*b*.

The first opening 55*a* is an elongated opening into which the lead wire is inserted. Specifically, the first opening 55*a* is a rectangular opening penetrating through the case top face 54 in the longitudinal direction, and has an end portion connected to the third opening 55*b*.

Furthermore, the third opening 55*b* is an opening which is connected to the first opening 55*a*, for guiding the lead wire, from the outside of the third opening 55*b* to the first opening 55*a*. Specifically, the third opening 55*b* is an opening penetrating through the case top face 54 in the longitudinal direction, and has one end connected to the circular opening at the center of the case top face 54 and the other end connected to the first opening 55*a*. In other words, the third opening 55*b* connects the central opening of the case top face 54 and the first opening 55*a*, and, with this, is able to guide the lead wire disposed at the central opening of the case top face 54 to the first opening 55*a*.

Furthermore, the third opening 55*b* is disposed to extend perpendicular to the first opening 55*a* from the end portion of the first opening 55*a*.

Furthermore, as shown in FIG. 5, a second opening 71, which is an elongated opening into which the lead wire is inserted, is formed in the circuit board 70. Specifically, the second opening 71 is a rectangular opening penetrating through the circuit board 70 in the longitudinal direction, and has an end portion connected to the circular opening at the center of the circuit board 70. In other words, the second opening 71 is a linear cut-out formed in the circuit board 70.

Here, since the circuit board 70 is disposed in front of the case 50, the second opening 71 is disposed in front of the first opening 55*a*. Details of the positional relationship between the openings of the case 50 and the circuit board 70 shall be described later.

Furthermore, a rotation regulating portion 72, which is a notch-like opening that regulates the rotation of the circuit board 70 by abutting the projection 53*a* formed in the case 50. Through such interfitting of the projection 53*a* and the rotation regulating portion 72, the position of the circuit board 70 within the case 50 is determined, and the positional relationship between the opening 55 of the case 50 and the second opening 71 of the circuit board 70 is defined.

Next, the positional relationship between the openings of the case 50 and the circuit board 70 shall be described in detail.

Figure 6:
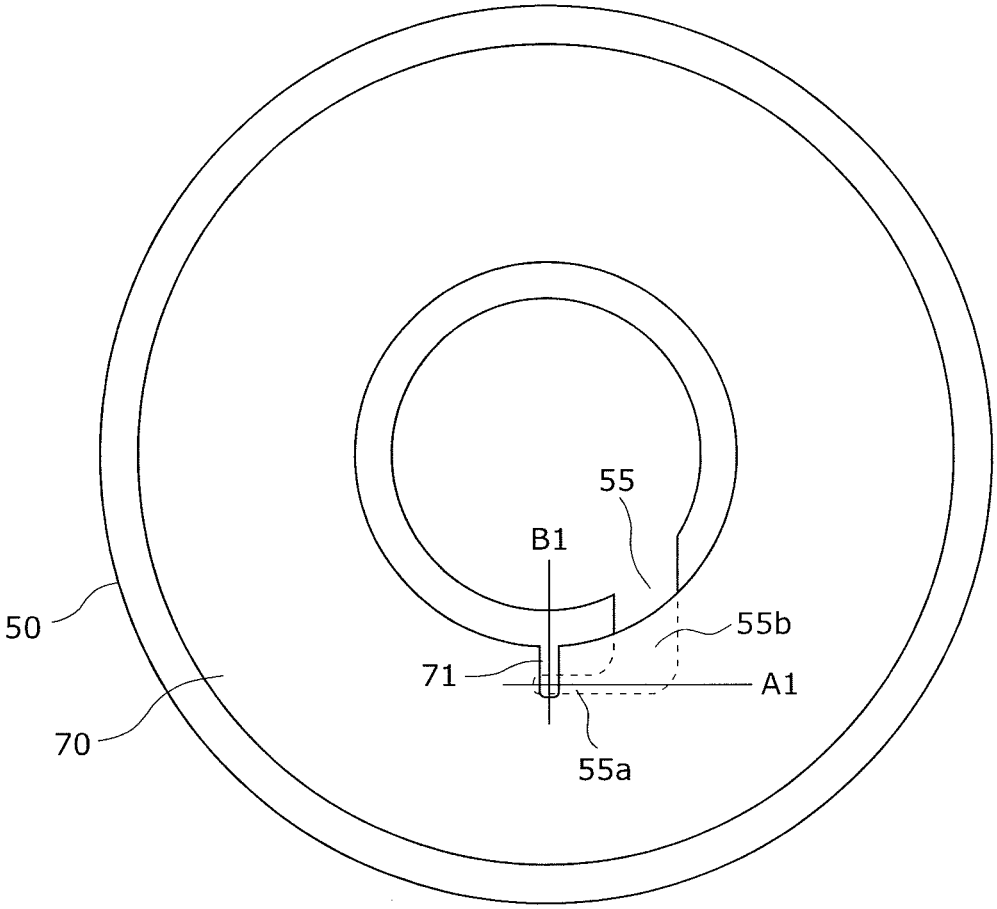
FIG. 6 is a diagram for describing the positional relationship between openings of the case and the circuit board according to Embodiment 1 of the present invention.
Figure 7:
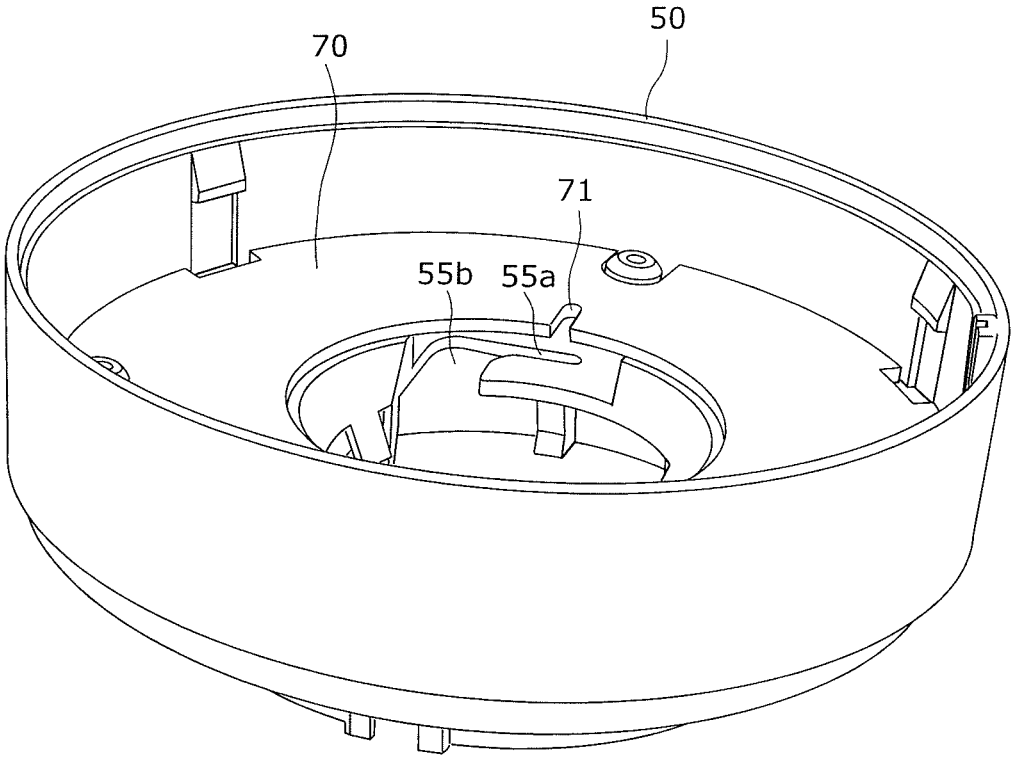
FIG. 7 is a diagram for describing the positional relationship between openings of the case and the circuit board according to Embodiment 1 of the present invention.
Figure 8:
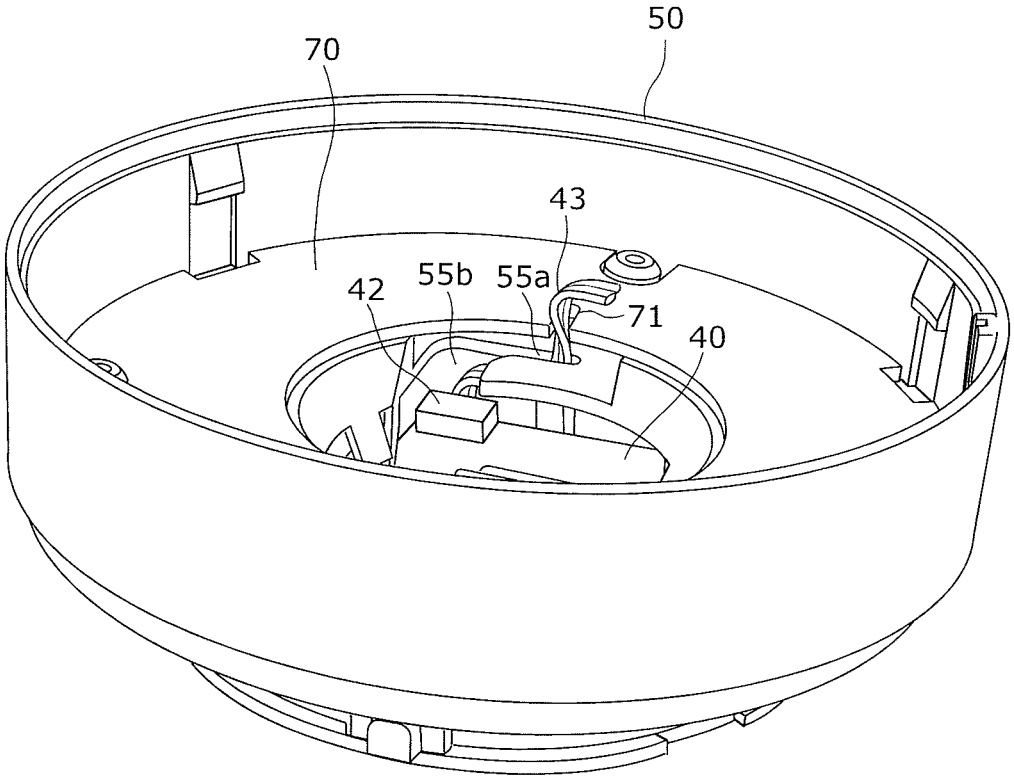
FIG. 8 is a diagram for describing the positional relationship between openings of the case and the circuit board according to Embodiment 1 of the present invention.

FIGS. 6 to 8 are diagrams for describing the positional relationship between the openings of the case 50 and the circuit board 70 according to Embodiment 1 of the present invention. Specifically, FIG. 6 is a plan view of the case 50 and the circuit board 70 as viewed from the front, and FIG. 7 is a perspective view of the case 50 and the circuit board 70 as viewed obliquely from the front. Furthermore, FIG. 8 is a perspective view of the lead wire arranged in the first opening 55*a* of the case 50 and the second opening 71 of the circuit board 70, as viewed obliquely from the front.

First, as shown in FIG. 6 and FIG. 7, the first opening 55*a* and the second opening 71 are disposed so that a straight line A1 extending in the lengthwise direction of the first opening 55*a* and a straight line B1 extending in the lengthwise direction of the second opening 71 three-dimensionally cross each other. Here, the three-dimensional crossing of the straight line A1 and the straight line B1 refers to the state in which the straight line A1 and the straight line B1 are neither parallel nor intersecting (not coplanar); that is, the straight line A1 and the straight line B1 are skewed in positions. In other words, in the state where the circuit board 70 is disposed inside the case 50, the first opening 55*a* and the second opening 71 are disposed so that, as seen from the alignment direction of the first opening 55*a* and the second opening 71 (in this embodiment, the front or the circuit board 70 planar view direction), the straight line A1 and the straight line B1 cross each other.

Specifically, the first opening 55*a* and the second opening 71 are disposed so that, as seen from the front, the tip of the first opening 55*a* and the tip of the second opening 71 overlap and the straight line A1 and the straight line B1 cross each other.

It should be noted that the tip of the first opening 55*a* and the tip of the second opening 71 need not overlap and the straight line A1 and the straight line B1 need not cross each other. Moreover, it is sufficient that an extension obtained when the first opening 55*a* is extended lengthwise and an extension obtained when the second opening 71 is extended lengthwise cross each other, and the first opening 55*a* and the second opening 71 need not cross each other.

Furthermore, the third opening 55*b* is disposed at a position that does not overlap with the second opening 71 as seen from the front (the circuit board 70 plan view direction). Although in this embodiment the third opening 55*b* is disposed apart from the second opening 71 and extending parallel to the second opening 71 as seen from the front, the angle formed by the third opening 55*b* and the second opening 71 is not particularly limited.

Furthermore, as shown in FIG. 8, a connector 42 is disposed on the mounting board 40, and a lead wire 43 extends from the connector 42. Here, the lead wire 43 is a copper alloy lead wire, and comprises a core wire of copper alloy and an insulating resin covering that coats the core wire.

During the assembly work of the LED unit 1, the lead wire 43 is inserted into the first opening 55*a* via the third opening 55*b*, and then inserted into the second opening 71. Then, by connecting the lead wire 43 to a connector (not illustrated) on the circuit board 70, the light-emitting element mounted on the mounting board 40 and the drive circuit are electrically connected.

In this manner, by inserting the lead wire 43 into the first opening 55*a* and the second opening 71, the lead wire 43 is arranged in a twisted manner. It should be noted that the lead wire 43 is a lead wire with an oblong cross-section, and the crosswise width of the first opening 55*a* and the second opening 71 are defined so as to conform to the crosswise width of the crosswise width of the cross-section of the lead wire 43.

As described above, according to the LED unit 1 according to Embodiment 1 of the present invention, the first opening 55*a* formed in the case 50 and the second opening 71 formed in the circuit board 70 are disposed so that a straight line extending in the lengthwise direction of the first opening 55*a* and a straight line extending in the lengthwise direction of the second opening 71 three-dimensionally cross each other. Accordingly, by inserting the lead wire 43 into the first opening 55*a* and the second opening 71, the lead wire 43 is arranged in a twisted manner, and thus the position of the lead wire 43 inside the case 50 can be determined. As such, since the lead wire 43 is disposed by being secured inside the case 50, it is possible to prevent the lead wire 43 from interfering with other components during the assembly of the LED unit 1, and thus the LED unit 1 assembly work can be performed easily.

Furthermore, the third opening 55*b* for guiding the lead wire 43 from the outside to the first opening 55*a* is formed in the case 50. Here, when the lead wire 43 is inserted into the first opening 55*a* before being inserted into the second opening 71, it is preferable that the third opening 55*b* be formed so that the initial insertion into the first opening 55*a* is performed smoothly. As such, guiding the lead wire 43 from the outside of the third opening 55*b* to the first opening 55*a* allows the lead wire 43 to be inserted easily into the first opening 55*a*. Furthermore, in the case where a through hole is to be provided in the case 50 and the lead wire 43 is inserted into the through hole, when the tip of the lead wire 43 has a connector, a large through hole that is at least as big as the connector width needs to be provided, and thus the work of providing a large hole takes time. However, according to the LED unit 1, it is sufficient to provide an opening having a width that is approximately the lead wire width which is less than the connector width, and insert the lead wire 43 into such opening, and thus there is no need to provide a large through hole.

Furthermore, the third opening 55*b* is disposed at a position that does not overlap with the second opening 71, as seen in the circuit board 70 plan view direction. Accordingly, even in the state where the lead wire 43 is inserted into the first opening 55*a* and the second opening 71, since the lead wire 43 is arranged in a twisted manner, it is possible to prevent the lead wire 43 from moving inside the case 50.

Furthermore, the first opening 55*a* and the third opening 55*b* make up an L-shaped cut-out formed in the case 50. With this, it is possible to easily guide the lead wire 43 from the outside of the third opening 55*b* to the first opening 55*a* via the third opening 55*b*, and position the lead wire 43 inside the case 50.

Furthermore, the second opening 71 is a linear cut-out formed in the circuit board 70. Specifically, since what is formed in the circuit board 70 is not an L-shaped cut-out but a linear cut-out, it is possible to ensure a large effective area for the circuit board 70 provided in the drive circuit.

(Modification 1 of Embodiment 1)

Next, Modification 1 of Embodiment 1 shall be described. In Embodiment 1, the opening 55 which is an L-shaped cut-out is formed in the case 50, and the opening 55 is configured of a first opening 55*a* and a third opening 55*b*. In contrast, in this modification, a linear cut-out is formed in the case.

Figure 9:
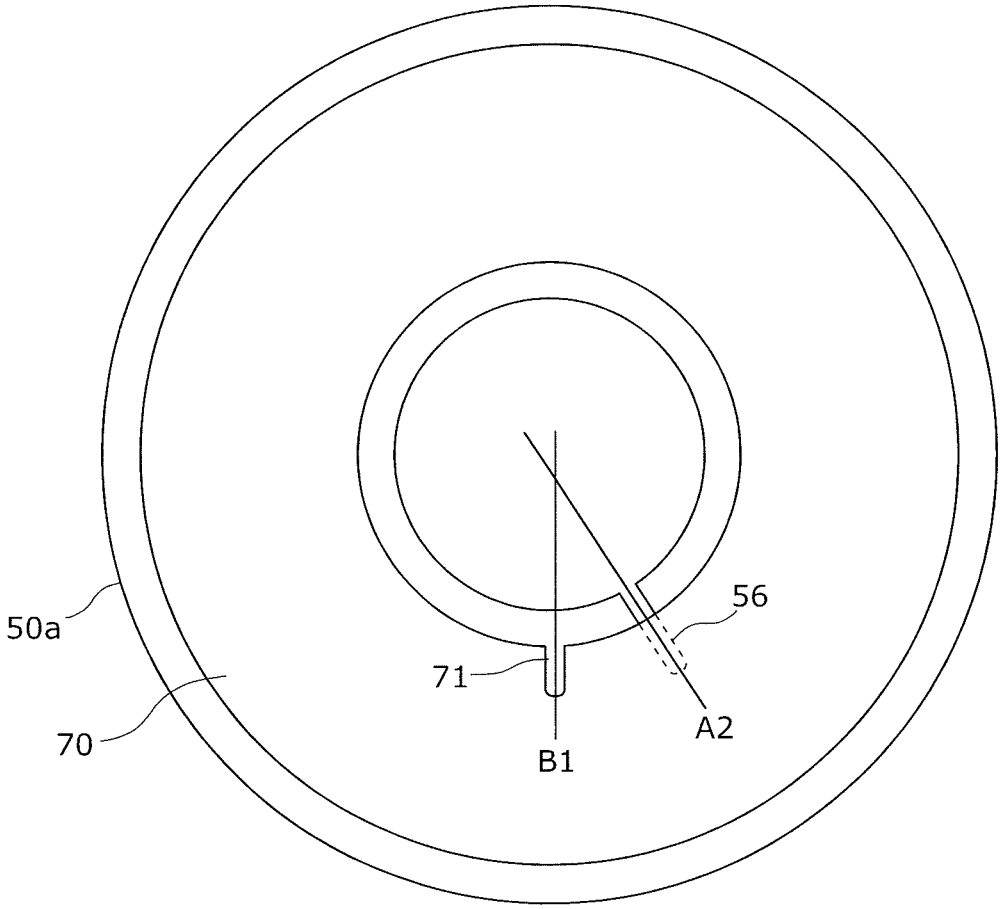
FIG. 9 is a diagram for describing the positional relationship between openings of the case and the circuit board according to Embodiment 1 of the present invention.

FIG. 9 is a diagram for describing the positional relationship between openings of a case 50*a* and the circuit board 70 according to Modification 1 of Embodiment 1 of the present invention. Specifically, FIG. 9 is a plan view of the case 50*a* and the circuit board 70 as viewed from the front.

As shown in the figure, a first opening 56, which is a linear cut-out, is formed in the case 50*a*. Here, the first opening 56 is an elongated opening disposed behind the second opening 71 and into which the lead wire is inserted.

Furthermore, the first opening 56 and the second opening 71 are disposed so that a straight line A2 extending in the lengthwise direction of the first opening 56 and the straight line B1 extending in the lengthwise direction of the second opening 71 three-dimensionally cross each other. Specifically, in the state where the circuit board 70 is disposed inside the case 50, the first opening 56 and the second opening 71 are disposed so that, seen from the front, the straight line A2 and the straight line B1 cross each other.

In addition, by inserting the lead wire into the first opening 56 and the second opening 71, the lead wire is arranged in a twisted manner inside the case 50*a*. It should be noted that other components of the LED unit according to this modification are the same as those in Embodiment 1, and thus detailed description shall be omitted.

As described above, according to the LED unit according to Modification 1 of Embodiment 1 of the present invention, the lead wire is disposed by being secured inside the case 50 as in Embodiment 1, and thus it is possible to prevent the lead wire from interfering with other components during the assembly of the LED, and thus the LED unit assembly work can be performed easily.

(Modification 2 of Embodiment 1)

Next, Modification 2 of Embodiment 1 shall be described. In Embodiment 1, the opening 55 which is an L-shaped cut-out is formed in the case 50, and the second opening 71 which is a linear cut-out is formed in the circuit board 70. However, in this modification, a linear cut-out is formed in the case, and an L-shaped cut-out is formed in the circuit board.

Figure 10:
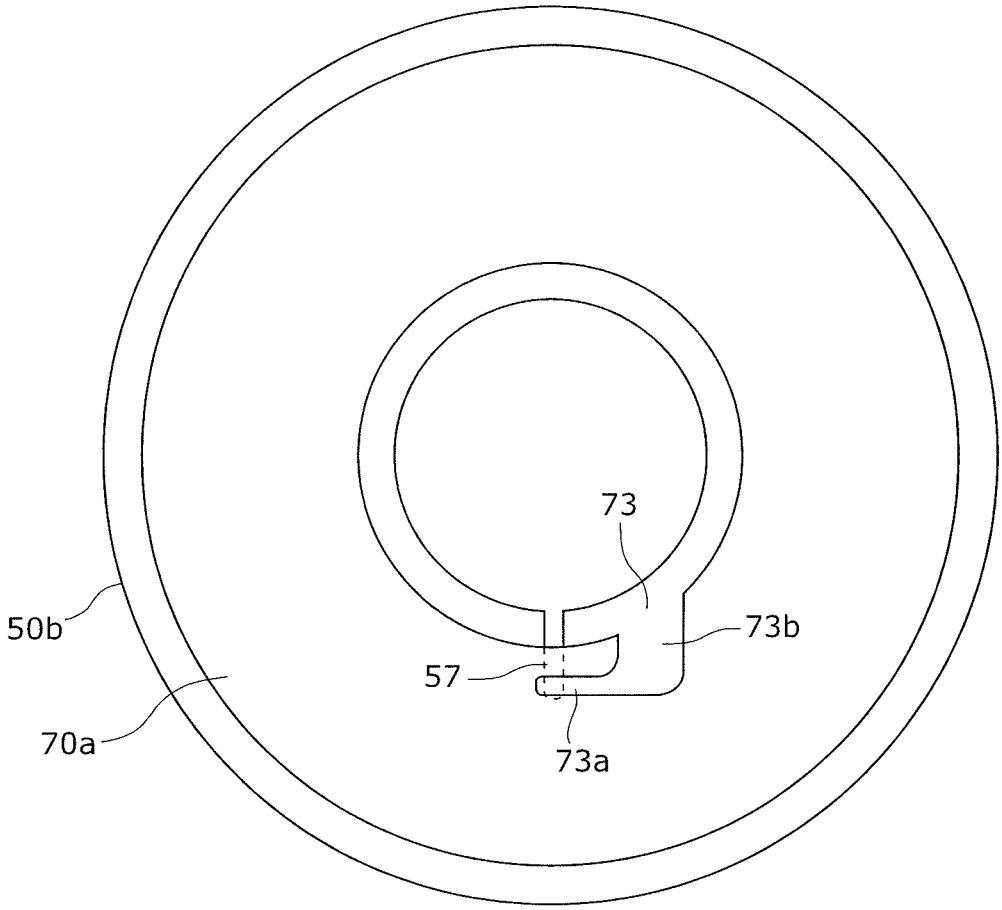
FIG. 10 is a diagram for describing the positional relationship between openings of the case and the circuit board according to Embodiment 1 of the present invention.

FIG. 10 is a diagram for describing the positional relationship between openings of a case 50*b* and a circuit board 70*a* according to Modification 2 of Embodiment 1 of the present invention. Specifically, FIG. 10 is a plan view of the case 50*b* and the circuit board 70*a* as viewed from the front.

As shown in the figure, a first opening 57, which is a linear cut-out, is formed in the case 50*b*. Here, the first opening 57 is an elongated opening into which the lead wire is inserted. Furthermore, an opening 73 which is an L-shaped cut-out is formed in the circuit board 70*a*. The opening 73 is configured of a second opening 73*a* and a fourth opening 73*b*.

The second opening 73*a* is an elongated opening disposed in front of the first opening 57 and into which the lead wire is inserted. Furthermore, the fourth opening 73*b* is an opening which is connected to the second opening 73*a*, for guiding the lead wire, from the outside of the fourth opening 73*b* to the second opening 73*a*. In other words, the fourth opening 73*b* connects the central opening of the circuit board 70*a* and the second opening 73*a*, and, with this, is able to guide the lead wire disposed at the central opening of the circuit board 70*a* to the second opening 73*a*.

Furthermore, the fourth opening 73*b* is disposed to extend perpendicular to the second opening 73*a* from the end portion of the second opening 73*a*, and the opening 73, which is an L-shaped cut-out, is formed by the second opening 73*a* and the fourth opening 73*b*.

In addition, the first opening 57 and the second opening 73*a* are disposed so that a straight line extending in the lengthwise direction of the first opening 57 and a straight line extending in the lengthwise direction of the second opening 73*a* three-dimensionally cross each other (cross each other as viewed from the front).

Furthermore, the fourth opening 73*b* is disposed at a position that does not overlap with the first opening 57 as seen from the front (the circuit board 70*a* plan view direction). Although in this modification the fourth opening 73*b* is disposed apart from the first opening 57 and extending parallel to the first opening 57 as seen from the front, the angle formed by the fourth opening 73*b* and the first opening 57 is not particularly limited.

In addition, by inserting the lead wire into the first opening 57 and the second opening 73*a*, the lead wire is arranged in a twisted manner inside the case 50*a*. It should be noted that other components of the LED unit according to this modification are the same as those in Embodiment 1, and thus detailed description shall be omitted.

As described above, according to the LED unit according to Modification 2 of Embodiment 1 of the present invention, the lead wire is disposed by being secured inside the case 50 as in Embodiment 1, and thus it is possible to prevent the lead wire from interfering with other components during the assembly of the LED, and thus the LED unit assembly work can be performed easily.

Furthermore, the fourth opening 73*b* for guiding the lead wire from the outside to the second opening 73*a* is formed in the circuit board 70*a*. Here, when the lead wire is to be inserted first into the second opening 73*a* of the circuit board 70*a* before being inserted into the first opening 57 of the case 50*b*, it is preferable that the fourth opening 73*b* be formed so that the initial insertion to the second opening 73*a* is performed smoothly. As such, by guiding the lead wire from the outside of the fourth opening 73*b* to the second opening 73*a*, the lead wire can be easily guided into the second opening 73*a*. Furthermore, in the case where a through hole is to be provided in the circuit board 70*a* and the lead wire is inserted into the through hole, when the tip of the lead wire has a connector, a large through hole that is at least as big as the connector width needs to be provided, and thus the work of providing a large hole takes time and the mounting area on the circuit board is reduced. However, according to the LED unit according to this modification, it is sufficient to provide an opening having a width that is approximately the lead wire width which is less than the connector width, and insert the lead wire into such opening, and thus there is no need to provide a large through hole and reduction of mounting area on the circuit board can be suppressed.

Embodiment 2

Next, a lighting apparatus 100 according to Embodiment 2 of the present invention shall be described.

Figure 11:
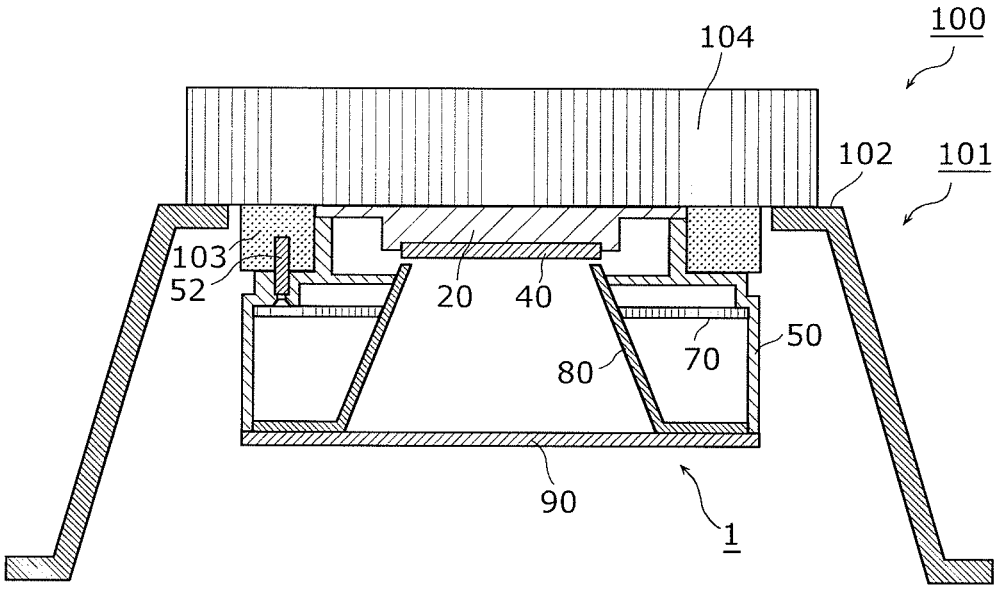
FIG. 11 is a cross-sectional view of a configuration of a lighting apparatus according to Embodiment 2 of the present invention.

FIG. 11 is a cross-sectional view of a configuration of the lighting apparatus 100 according to Embodiment 2 of the present invention. It should be noted that the lighting apparatus according to this embodiment uses the LED unit 1 according to Embodiment 1. Therefore, in the figure, the same reference signs are given to structural components that are the same as the structural components shown in Embodiment 1.

As shown in the figure, the lighting apparatus 100 is, for example, a downlight and includes lighting equipment 101, and the LED unit 1 according to Embodiment 1. The lighting equipment 101 includes: a main body which includes a reflecting plate 102 and a heat-dissipating component 104 and is configured to cover the LED unit 1; and a socket 103 attached to the main body.

The reflecting plate 102 is substantially in the shape of a cup having a circular opening formed on the top face, and is configured so as to laterally surround the LED unit 1. Specifically, the reflecting plate 102 includes: as the top face, a circular flat plate portion in which a circular opening is formed; and a cylinder portion that is formed to have an inner diameter which gradually widens from the periphery of the flat plate portion to the bottom. The cylinder portion has an opening on the light-emission side, and is configured to reflect the light from the LED unit 1. For example, the reflecting plate 102 is made of a white synthetic resin having insulating properties. It should be noted that, in order to improve reflectivity, the inner face of the reflecting plate 102 may be coated with a reflective film. Moreover, the reflecting plate 102 is not limited to a reflecting plate made of synthetic resin, and a metal reflective plate formed from a pressed metal plate may be used.

The socket 103 is compatible with the GH76p base, and is a disk-shaped component that supplies AC power to the LED unit 1. The socket 103 is arranged so that its upper portion is inserted inside the opening formed in the flat plate portion in the top face of the reflecting plate 102. An opening shaped to conform to the shape of the base of the support 20 is formed at the center of the socket 103, and the top face of the LED unit 1 and the bottom face of the heat-dissipating component 104 are thermally connected by installing the LED unit 1 in such opening. Furthermore, a connection hole into which an electrical connection pin 52 is inserted is formed at a position at the bottom portion of the socket 103 which corresponds to the electrical connection pin 52 of the case 50.

The heat-dissipating component 104 is a component which dissipates the heat transmitted from the LED unit 1. The heat-dissipating component 104 is disposed to abut the top face of the reflecting plate 102 and the top face of the socket 103. It is preferable that the heat-dissipating component 104 be made of highly heat-conductive material such as aluminum.

It should be noted that the LED unit 1 is installed in the socket 103 in a removable manner.

As described above, according to the lighting apparatus 100 according to Embodiment 2 of the present invention, the inclusion of the LED unit 1 according to Embodiment 1 makes it possible to produce the same advantageous effects as in Embodiment 1. It should be noted that the same modification as in the foregoing embodiment and modifications may be carried out in this embodiment.

Embodiment 3

Next, an LED unit 2 according to Embodiment 3 of the present invention shall be described.

Figure 12:
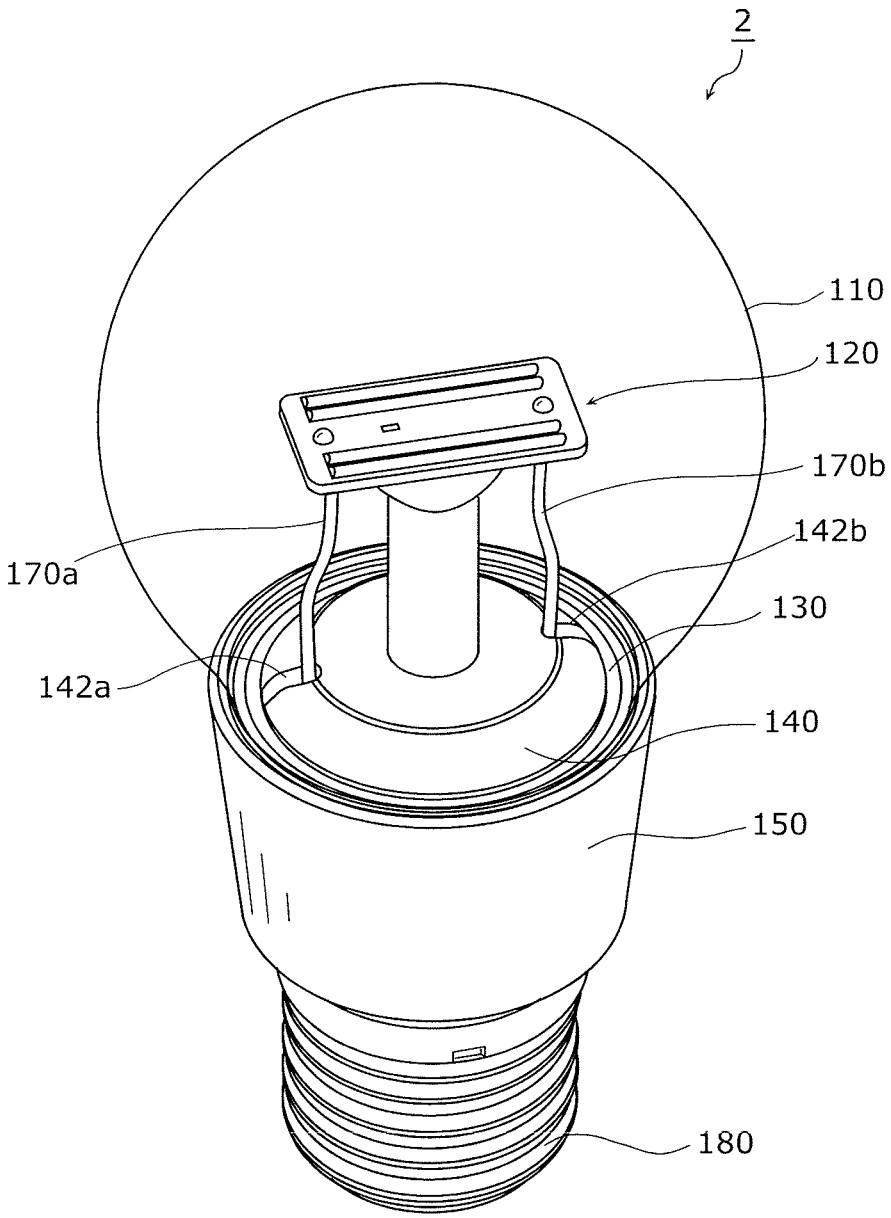
FIG. 12 is a perspective view of an external appearance of an LED unit according to Embodiment 3 of the present invention.
Figure 13:
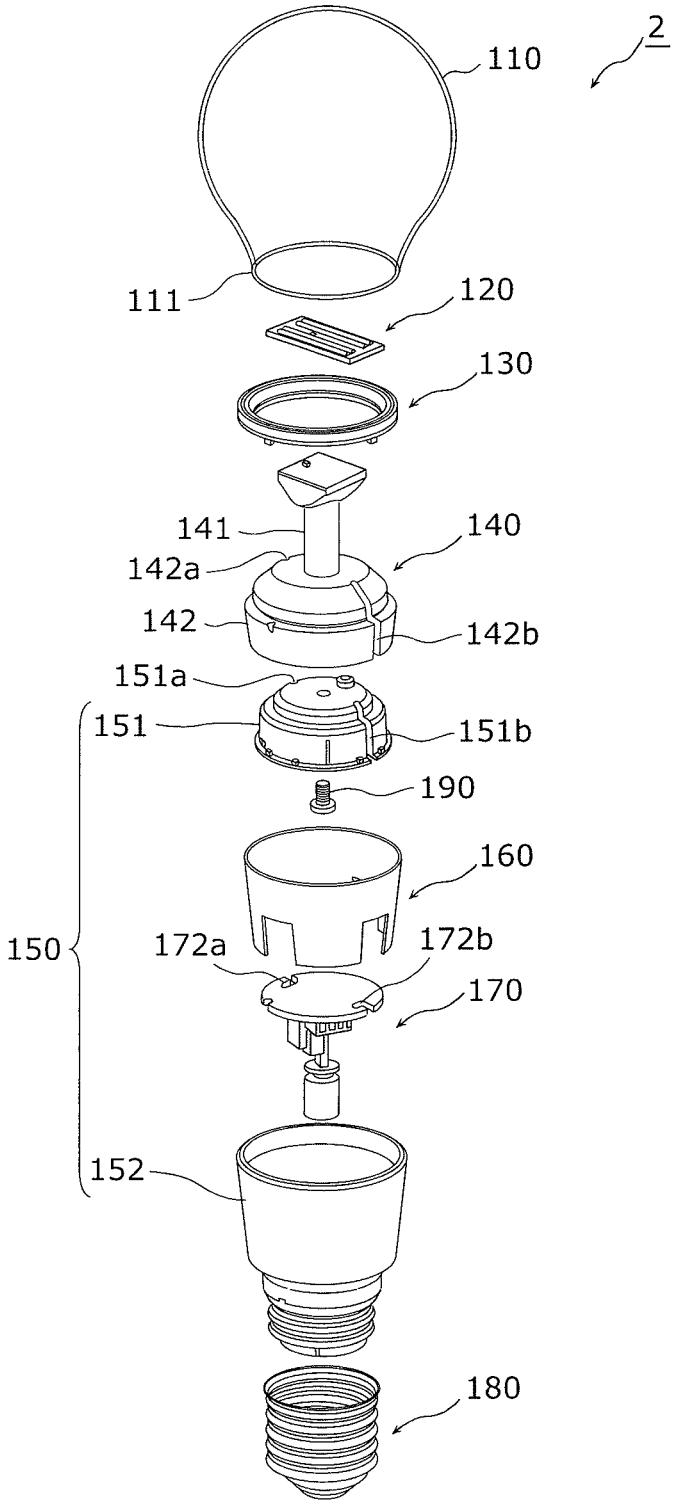
FIG. 13 is an exploded perspective view of the LED unit according to Embodiment 3 of the present invention.
Figure 14A:
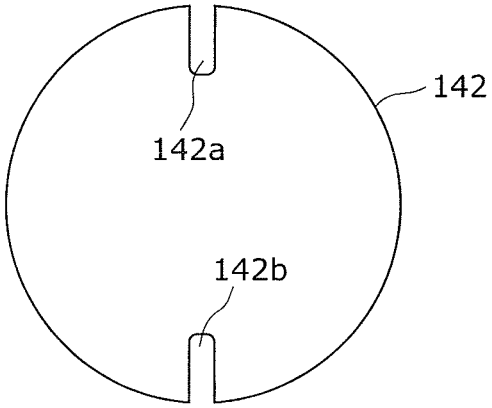
FIG. 14A is a plan view of a configuration of openings formed in a support component according to Embodiment 3 of the present invention.
Figure 14B:
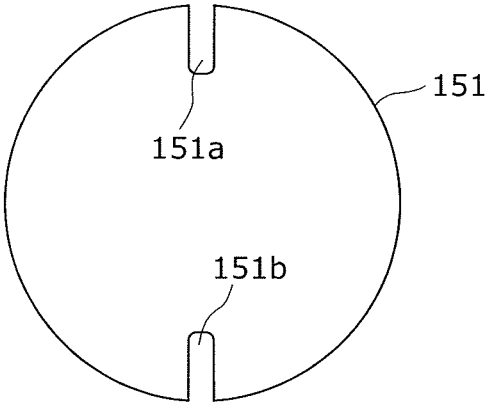
FIG. 14B is a plan view of a configuration of openings formed in a case according to Embodiment 3 of the present invention.
Figure 14C:
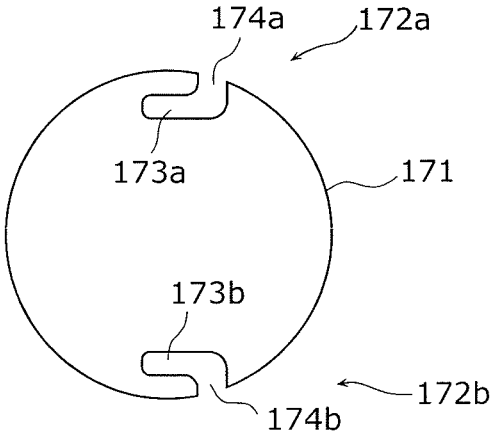
FIG. 14C is a plan view of a configuration of openings formed in a circuit board according to Embodiment 3 of the present invention.

FIG. 12 is a perspective view of an external appearance of the LED unit 2 according to Embodiment 3 of the present invention. Furthermore, FIG. 13 is an exploded perspective view of the LED unit 2 according to Embodiment 3 of the present invention. Furthermore, FIG. 14A to FIG. 14C are plan views of a configuration of a support component 140, a case 150, and a circuit board 171, respectively, according to Embodiment 3 of the present invention. Specifically, FIG. 14A is a plan view of the support component 140 and a pedestal 142 as viewed from the front, FIG. 14B is a plan view of an inner case portion 151 of the case 150 as seen from the front, and FIG. 14C is a plan view of the circuit board 171 as viewed from the front.

It should be noted that in the subsequent description, description shall be carried out with the direction towards the bottom of the figures being referred to as the front and the direction toward the top of the figures being referred as the back. In other words, a base 180 is disposed in front of a globe 110. It should be noted that the above-described definition of directions does not concern the direction when the LED unit 2 is attached to lighting equipment.

As shown in the figures, the LED unit 2 according to this embodiment is a light bulb-shaped LED lamp which is a substitute for a light bulb-shaped fluorescent light or an incandescent light bulb. The LED unit 2 includes: the globe 110, and LED module 120 which is a light source, the support component which supports the LED module 120, the case 150 inside of which a drive circuit 170 is disposed, a metal component 160 disposed inside the case 150, the drive circuit 170 which supplies power to the LED module 120, and the base 180 which receives power from the outside.

It should be noted that, aside from the above components, the LED unit 2 includes lead wires 170*a* to 170*d*, a ring-shaped coupling component 130, and a screw 190. Furthermore, an envelope of the LED unit 2 is configured of the globe 110, the case 150 (outer case portion 152), and the base 180. In other words, the globe 110, the case 150 (outer case portion 152), and the base 180 are exposed to the outside, and their outer surfaces are exposed to outside air. Furthermore, the LED unit 2 in this embodiment is configured to have a brightness equivalent to, for example, 40 W.

The globe 110 is a translucent cover which houses the LED module 120 and transmits the light from the LED module 120 to the outside of the LED unit. The light of the LED module 120 which is incident on the inner surface of the globe 110 is brought out to the outside of the globe 110 by passing through the globe 110.

The globe 110 in this embodiment is a glass bulb (clear bulb) made of silica glass which is transparent with respect to visible light. Therefore, the LED module 120 housed inside the globe 110 cab be seen from outside the globe 110.

The globe 110 has a shape in which one end is a closed spheroid and the other end includes an opening 111. Specifically, the shape of the globe 110 is a shape in which a part of a hollow sphere narrows while stretching in a direction away from the center of the sphere. The opening 111 is formed at the position that is distanced from the center of the sphere. For the globe 110 having the above-described shape, a glass bulb having the same shape as a typical incandescent light bulb can be used. For example, glass bulbs of the A-shape, G-shape, E-shape, or the like can be used as the globe 110.

It should be noted that the globe 110 does not necessarily have to be transparent with respect to visible light, and the globe 110 may have a light-diffusing function. For example, a creamy white light-diffusing film may be formed by applying, on the entire inner surface or outer surface of the globe 110, a resin, white pigment, or the like, which contains a light-diffusing material such as silica, calcium carbonate, or the like. In this manner, by providing the globe 110 with a light-diffusing function, the light from the LED module 120 which is incident on the globe 110 can be diffused, and thus the light distribution angle of the LED unit can be expanded easily.

Furthermore, the shape of the globe 110 is not limited to the A-shape and the like, and may be a spheroid or an oblate spheroid. Furthermore, for the material of the globe 110, aside from glass material, it is possible to use a resin material made of a synthetic resin or the like such as acrylic (PMMA) or polycarbonate (PC), or the like.

The LED module 120 is a light-emitting module which includes semiconductor light-emitting elements making up a light-emitting unit, and emits a light of a predetermined color. The LED module 120 is disposed inside the globe 110, and is preferably disposed at a center position (for example, in a large-diameter portion in which the inner diameter of the globe 110 is largest) of the spherical shape formed by the globe. In this manner, by disposing the LED module 120 at the center position of the globe 110, the light distribution characteristics of the LED unit 2 approximates the light distribution characteristics of an incandescent bulb which uses a conventional filament coil.

Furthermore, the LED module 120 is held in mid-air inside the globe 110 by the support component 140, and emits light according to the power supplied via the lead wires 170*a* and 170*b*.

The coupling component 130 links the globe 110, the support component 140, and the metal component 160. The coupling component 130 is formed in a ring-shape so as to surround the perimeter of the pedestal 142 of the support component 140 to be described later. The coupling component 130 can be formed by curing a liquid insulating resin (for example, silicon) that is poured in the gap between the outer circumferential face of the pedestal 142 of the support component 140 and the outer portion of the outer case portion 152.

The support component 140 is a component which supports the LED module 120, and is made of metal. The support component 140 (metal support pillar) is includes: a support pillar 141 which is mainly located inside the globe 110; and the pedestal 142 which is mainly surrounded by the case 150 (outer case portion 152). In this embodiment, the support pillar 141 and the pedestal 142 are integrally formed using the same material.

The support pillar 141 is a metal stem provided extending from the vicinity of the opening 111 of the globe 110 toward the inside of the globe 110. The support pillar 141 functions as a support component which supports the LED module 120, with one end of the support pillar 141 is connected to the LED module 120 and the other end of the support pillar 141 is connected to the pedestal 142.

Furthermore, the support pillar 141 is made of a metal material and thus also functions as a heat-dissipating component for dissipating the heat generated by the LED module 120. The support pillar 141 in this embodiment is made of an aluminum alloy. In this manner, since the support pillar 141 is made of a metal material, the heat generated by the LED module 120 can be efficiently conducted to the support pillar 141. With this, it is possible to suppress the deterioration of light-emitting efficiency and shortening of operational life of the LED caused by rising temperature.

The pedestal 142 is a component which supports the support pillar 141, and is configured to block the opening 111 of the globe 110. The pedestal 142 is made of a metal material, and, in this embodiment, is made of an aluminum alloy in the same manner as the support pillar 141. With this, the heat of the LED module 120 that is conducted to the support pillar 141 can be efficiently conducted to the pedestal 142.

Here, a support component opening 142*a* which is an opening into which the lead wire 170*a* is inserted, and a support component opening 142*b* which is an opening into which the lead wire 170*b* is inserted, are formed in the pedestal 142 of the support component 140. Seen from the front, the support component openings 142*a* and 142*b* are elongated openings. Specifically, the support component openings 142*a* and 142*b* are linear cut-outs formed in the pedestal 142 of the support component 140, and have respective tips which are disposed so as to be mutually opposed.

The case 150 is an insulating case having insulating properties and inside of which the drive circuit 170 is disposed, and is configured of the inner case portion (first case portion) 151 and the outer case portion (second case portion) 152. The case 150 can be fabricated using an insulating resin material, and, for example, can be formed from resin such as polybutylene terephthalate (PBT).

The inner case portion 151 is disposes so as to surround the drive circuit 170, and is an inner case (circuit case) disposed so as not to be visible from outside the LED unit. Furthermore, the outer case portion 152 is at least a part of the lamp envelope, and is an outer component disposed so as to be visible from outside the LED unit. Of the outer circumferential face of the outer case portion 152, the region other than the portion covered by the base 180 is exposed to the outside of the LED unit.

Here, first openings 151*a* and 151*b*, which are openings disposed under (in front of) the support component openings 142*a* and 142*b*, respectively, and into which the lead wires 170*a* and 170*b* are inserted, are formed in the inner case portion 151 of the case 150. Seen from the front, the first openings 151*a* and 151*b* are elongated openings. Specifically, the first openings 151*a* and 151*b* are linear cut-outs formed in the inner case portion 151 of the case 150, and have respective tips which are disposed so as to be mutually opposed.

The metal component 160 is configured in a skirt-shape so as to surround the inner case portion 151 of the case 150, and is disposed between the inner case portion 151 and the outer case portion 152. With this, the metal component 160 can be placed in a contactless state with the drive circuit 170, and thus the insulating properties of the drive circuit 170 can be ensured.

Furthermore, the metal component 160 is made of a metal material, and functions as a heat pump. With this, the heat generated from the LED module 20 and the drive circuit 170 can be efficiently dissipated using the metal component 160. Specifically, the heat generated from the LED module 20 and the drive circuit 170 can be conducted to the outer case portion 152 via the inner case portion 151 and the metal component 160, and dissipated to the outside of the LED unit from the outer case portion 152.

For the material of the metal component 160, it is possible to use, for example, Al, Ag, Au, Ni, Rh, Pd, or an alloy of at least two thereof, or an alloy of Cu and Ag. Since such a metal material has excellent heat-conductivity, the heat propagated to the metal component 160 can be efficiently propagated.

The drive circuit (circuit unit) 170 is a light-up circuit (power source circuit) for causing the LED of the LED module 120 to light up (emit light), and supplies predetermined power to the LED module 120. For example, the drive circuit 170 converts, into direct current power, the alternating current power supplied from the base 180 via the pair of the lead wires 170*c* and 170*d*, and supplies the direct current power to the LED module 120 via the pair of the lead wires 170*a* and 170*b*. It should be noted that, in FIG. 13, the lead wires 170*a* to 170*d* are omitted in the illustration.

The drive circuit 170 is configured of a circuit board 171 and plural circuit elements (electronic components) mounted on the circuit board 171.

The circuit board 171 is a printed board on which metal wiring is formed by patterning, and electrically connects the circuit elements mounted on the circuit board 171. In this embodiment, the circuit board 171 is disposed such that its principal surface is oriented orthogonally to the lamp axis. The circuit elements are, for example, various types of capacitors, resistor elements, rectifier circuit elements, coil elements, choke coils (choke transistors), noise filters, diodes, or integrated circuit elements, and so on.

Since the drive circuit 170 configured in the aforementioned manner is covered by the inner case portion 151 of the case 150, the drive circuit 170 does not come into contact with the metal component 160. With this, the insulation properties of the drive circuit 170 are ensured. It should be noted that the drive circuit 170 is not limited to only a smoothing circuit, and a dimmer circuit, a booster circuit, or the like, can be selected and combined as necessary.

Here, openings 172*a* and 172*b*, which are openings disposed under (in front of) the first openings 151*a* and 151*b*, respectively, and into which the lead wires 170*a* and 170*b* are inserted, are formed in the circuit board 171 of the drive circuit 170. Each of the openings 172*a* and 172*b* is an L-shaped cut-out. The opening 172*a* is configured of second openings 173*a* and 173*b*, and the opening 172*b* is configured of fourth openings 174*a* and 174*b*.

The second openings 173*a* and 173*b* are elongated openings which are disposed under (in front of) the first openings 151*a* and 151*b*, respectively, and into which the read wires 170*a* and 170*b* are inserted. Furthermore, the fourth openings 174*a* and 174*b* are openings which are connected to the second openings 173*a* and 173*b*, respectively, for guiding the lead wires 170*a* and 170*b*, from the outside of the fourth openings 174*a* and 174*b* to the second openings 173*a* and 173*b*. In other words, the fourth openings 174*a* and 174*b* connect the outside of the circuit board 171 and the second openings 173*a* and 173*b*, and, with this, the lead wires 170*a* and 170*b* disposed outside the circuit board 171 can be guided to the second openings 173*a* and 173*b*.

Furthermore, the fourth openings 174*a* and 174*b* are respectively disposed to extend perpendicularly to the second openings 173*a* and 173*b* from the end portion of the second openings 173*a* and 173*b*. The opening 172*a* which is an L-shaped cut-out is configured of the second opening 173*a* and the fourth opening 174*a*. Furthermore, the opening 172*b* which is an L-shaped cut-out is configured of the second opening 173*b* and the fourth opening 174*b*.

In addition, the first openings 151*a* and 151*b* and the second openings 173*a* and 173*b* are disposed so that straight lines extending in the lengthwise direction of the first openings 151*a* and 151*b* and the corresponding straight lines extending in the lengthwise direction of the second openings 173*a* and 173*b* three-dimensionally cross each other. Specifically, seen from the front, the first openings 151*a* and 151*b* and the second openings 173*a* and 173*b* are respectively disposed to cross each other. Furthermore, the same is true for the support component openings 142*a* and 142*b* as with the first openings 151*a* and 151*b*.

Furthermore, each of the fourth openings 174*a* and 174*b* is disposed at a position that does not overlap with the corresponding one of the first openings 151*a* and 151*b* as seen from the front (the circuit board 171 plan view direction). Although in this embodiment each of the fourth openings 174*a* and 174*b* is disposed apart from the corresponding one of the first openings 151*a* and 151*b* and extending parallel to the corresponding one of the first openings 151*a* and 151*b* as seen from the front, the angle formed by the fourth openings 174*a* and 174*b* and the first openings 151*a* and 151*b* is not particularly limited Furthermore, the same is true for the support component openings 142*a* and 142*b* as with the first openings 151*a* and 151*b*.

Each of the lead wires 170*a* to 170*d* is a copper alloy lead wire, and comprises a core wire of copper alloy and an insulating resin covering that coats the core wire.

The paired lead wires 170*a* and 170*b* are electrical wires for supplying, from the drive circuit 170 to the LED module 120, the direct current power for causing the LED module 120 to light up. The drive circuit 170 and the LED module 120 are electrically connected by way of the pair of the lead wires 170*a* and 170*b*. Specifically, for each of the lead wires 170*a* and 170*b*, one end (core wire) is electrically connected, by soldering or the like, to the power output unit (metal wire) of the circuit board 171, and the other end (core wire) is electrically connected, by soldering or the like, to the power input unit (electrode terminal) of the LED module 120.

In addition, each of the lead wires 170*a* and 170*b* is inserted into the corresponding one of the second openings 173*a* and 173*b* via the corresponding one of the fourth openings 174*a* and 174*b*, and then inserted into the corresponding ones of the first openings 151*a* and 151*b* and support component openings 142*a* and 142*b*. With this, the lead wires 17*a* and 170*b* are arranged in a twisted manner.

Furthermore, the paired lead wires 170*c* and 170*d* are electric wires for supplying, to the drive circuit 170, the alternating current power from the base 180. The drive circuit 170 and base 180 are electrically connected by way of the pair of the lead wires 170*c* and 170*d*. Specifically, for each of the lead wires 170*c* and 170*d*, one end (core wire) is electrically connected, by soldering or the like, to the base 180 (shell or eyelet), and the other end (core wire) is electrically connected, by soldering or the like, to the power input unit (metal wire) of the circuit board 171.

The base 180 is a power receiving unit which receives, from outside of the LED unit, power for causing the LED of the LED module 120 to emit light. The base 180 is, for example, attached to the socket of lighting equipment, and, when causing the LED unit 2 to light up, the base 180 receives power from the socket of the lighting equipment. For example, alternating current power is supplied from a commercial power source (AC 100V) to the base 180. The base 180 in this embodiment receives alternating current power via two contact points, and the power received by the base 180 is input to the power input unit of the drive circuit 170 via the pair of the lead wires 170*c* and 170*d*.

The base 180 is a bottomed cylinder made of metal, and includes a shell whose outer circumferential face is an external thread, and an eyelet which is attached to the shell via an insulating portion. Furthermore, a screw portion for threaded connection with the socket of the lighting equipment is formed in the outer circumferential face of the base 180, and a screw portion for threaded coupling with the screw portion of the outer case portion 152 is formed in the inner circumferential face of the base 180.

Although the base 180 is not limited to a particular type, a threaded Edison-type (E-type) base is used in this embodiment. Examples of the base 180 include the E26 type or the E17 type, or the E16 type, or the like.

As described above, according to the LED unit 2 according to Embodiment 3 of the present invention, since the lead wires are disposed by being secured, it is possible to prevent the lead wires from interfering with other components during the assembly of the LED unit, the LED unit assembly work can be performed easily, and so on, and thus the same advantageous effects as in Embodiment 1 can be produced. It should be noted that the same modification as in the foregoing embodiment and modifications may be carried out in this embodiment.

Although LED units, as illumination light sources, and a lighting apparatus according to the embodiments of the present invention and modifications thereof have been described, the present invention is not limited to the above-described embodiments and modifications thereof. Specifically, the embodiments and modifications thereof disclosed herein should be considered, in all points, as examples and are thus not limiting. The scope of the present invention is defined not by the foregoing description but by the Claims, and includes all modifications that have equivalent meaning to and/or are within the scope of the Claims. Furthermore, forms obtained by arbitrarily combining the above-described embodiments and modifications are also included in the scope of the present invention. Furthermore, the present invention may be configured by arbitrarily combining partial components in the embodiments and modifications thereof.

For example, in the foregoing embodiments and modifications thereof, the LED unit is a disc-shaped or low-profile LED lamp or light bulb-shaped LED lamp. However, the LED unit may be a straight tube LED lamp which uses LEDs as a light-emitting principle while maintaining the shape of a conventional straight tube fluorescent lamp. Specifically, the straight tube LED lamp may include a case in which a first opening is formed, and a circuit board on which a second opening is formed, such as in the foregoing embodiments.

Furthermore, although the case is a cylindrical component in Embodiments 1 and 2 and the modifications, the shape of the case is not limited to such. For example, the case may be configured in a polygonal cylinder-shape such as a quadrangular cylinder, a pentagonal cylinder, a hexagonal cylinder, or an octagonal cylinder, or in a truncated cone-shape.

Furthermore, although the heat-conducting sheet 30, the mounting board 40, the circuit board, and the reflecting mirror 80 are disposed inside the case in the Embodiments 1 and 2 and the modifications, each of these components may be entirely or partially disposed outside the case.

Furthermore, optical components such as a lens or reflector for focusing the light from the light-emitting unit, or optical filters, and the like, for color tone-adjustment may be used in the above-described embodiments and modifications. However, such components are not essential components for the present invention.

Furthermore, although the light-emitting unit has a COB-type configuration in which the LED chip is directly mounted on the mounting board, the configuration of the light-emitting unit is not limited to such. For example, it is also acceptable to use a surface mounted device (SMD) light-emitting unit configured by using packaged LED elements, in each of which the LED chip is mounted inside a cavity formed using resin and the inside of the cavity is enclosed by a phosphor-containing resin, and mounting a plurality of the LED elements on a board.

Furthermore, although the light-emitting unit is configured to emit white light by using a blue light-emitting LED and yellow phosphor in the foregoing embodiments and modifications, the present invention is not limited to such configuration. For example, it is possible to emit white light by using a phosphor-containing resin which contains red phosphor and green phosphor, and combining such resin with a blue light-emitting LED.

Furthermore, the light-emitting unit may use an LED which emits light of a color other than blue. For example, when using an ultraviolet light-emitting LED chip as the LED, a combination of respective phosphor particles for emitting light of the three primary colors (red, green, blue) can be used as the phosphor particles. In addition, a wavelength converting material other than phosphor particles may be used, and, as a wavelength converting material, it is possible to use a material including a substance which absorbs light of a certain wavelength and emits light of a wavelength different to that of the absorbed light, such as a semiconductor, a metal complex, an organic dye, or a pigment.

Furthermore, although an LED is given as an example of a light-emitting element in the foregoing embodiments and modifications, semiconductor light-emitting elements such as a semiconductor laser, or light-emitting elements such as organic electro luminescence (EL) elements or non-organic EL elements may be used.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

INDUSTRIAL APPLICABILITY

The illumination light source according to the present invention can be widely used as an LED unit (LED lamp), or the like, that includes, for example, a GH76p base.

The invention claimed is:

1. An illumination light source comprising:

a light-emitting element;

a circuit board provided in a drive circuit which drives the light-emitting element;

a lead wire electrically connecting the light-emitting element and the drive circuit; and a case including a first opening which is an elongated opening into which the lead wire is inserted, wherein the circuit board includes a second opening which is an elongated opening into which the lead wire is inserted, and the first opening and the second opening are disposed so that a straight line extending in a lengthwise direction of the first opening and a straight line extending in a lengthwise direction of the second opening three-dimensionally cross each other.

2. The illumination light source according to claim 1, wherein the case further includes a third opening which is an opening connected to the first opening, for guiding the lead wire from outside to the first opening.

3. The illumination light source according to claim 2, wherein the third opening is disposed at a position that does not overlap with the second opening, when seen from a plan view direction of the circuit board.

4. The illumination light source according to claim 2, wherein the first opening and the third opening make up an L-shaped cut-out formed in the case.

5. The illumination light source according to claim 1, wherein the second opening is a linear cut-out formed in the circuit board.

6. The illumination light source according to claim 1, wherein the circuit board further includes a fourth opening which is an opening connected to the second opening, for guiding the lead wire from outside to the second opening.

7. A lighting apparatus comprising:

the illumination light source according to claim 1; and lighting equipment to which the illumination light source is attached, wherein the lighting equipment includes:

a main body configured to cover the illumination light source; and a socket attached to the main body, for supplying power to the illumination light source.

8. The illumination light source according to claim 1, wherein the circuit board is accommodated within the case.

9. The illumination light source according to claim 1, wherein the lengthwise direction of the first opening is oriented parallel to a planar surface of the case and a lengthwise direction of the second opening is oriented parallel to a planar surface of the circuit board.

* * * * *